United States Patent [19]

Hensel

[11] Patent Number: 4,699,109

[45] Date of Patent: Oct. 13, 1987

[54] CLOSED END FUEL INJECTION SYSTEM

[75] Inventor: Robert J. Hensel, Oshkosh, Wis.

[73] Assignee: Brunswick Corporation, Skokie, Ill.

[21] Appl. No.: 898,129

[22] Filed: Aug. 19, 1986

[51] Int. Cl.[4] ..... F02D 41/32; F02M 37/08

[52] U.S. Cl. ..... 123/458; 123/478

[58] Field of Search ..... 123/458, 497, 478, 457, 123/462, 463, 510, 511, 512

[56] References Cited

U.S. PATENT DOCUMENTS

| | | | |
|---|---|---|---|
| 3,465,732 | 9/1969 | Kattchee | 123/458 |
| 3,699,931 | 10/1972 | Cinquegrani | 123/478 X |
| 3,967,598 | 7/1976 | Rachel | 123/478 X |
| 4,565,173 | 1/1986 | Oshiage et al. | 123/458 |

*Primary Examiner*—Tony M. Argenbright

*Attorney, Agent, or Firm*—Andrus, Sceales, Starke & Sawall

[57] ABSTRACT

A marine fuel supply system for a fuel injected engine (10) deadheads a high pressure fuel line (27) with a closed-end connection to the fuel injectors (24) without a recirculating return fuel line to the fuel injection pump (25) and without a return fuel line to the remote fuel tank (29). A differential pressure transducer (33) senses differential pressure across the fuel injector (24) between the high pressure fuel line (27) and the low pressure induction manifold (17) and turns off the fuel pump (25) above a first value of relative differential pressure and turns on fuel pump (25) at a second value below the first value, to maintain the fuel pressure in the high pressure line (27) within a given range relative to induction manifold pressure.

6 Claims, 1 Drawing Figure

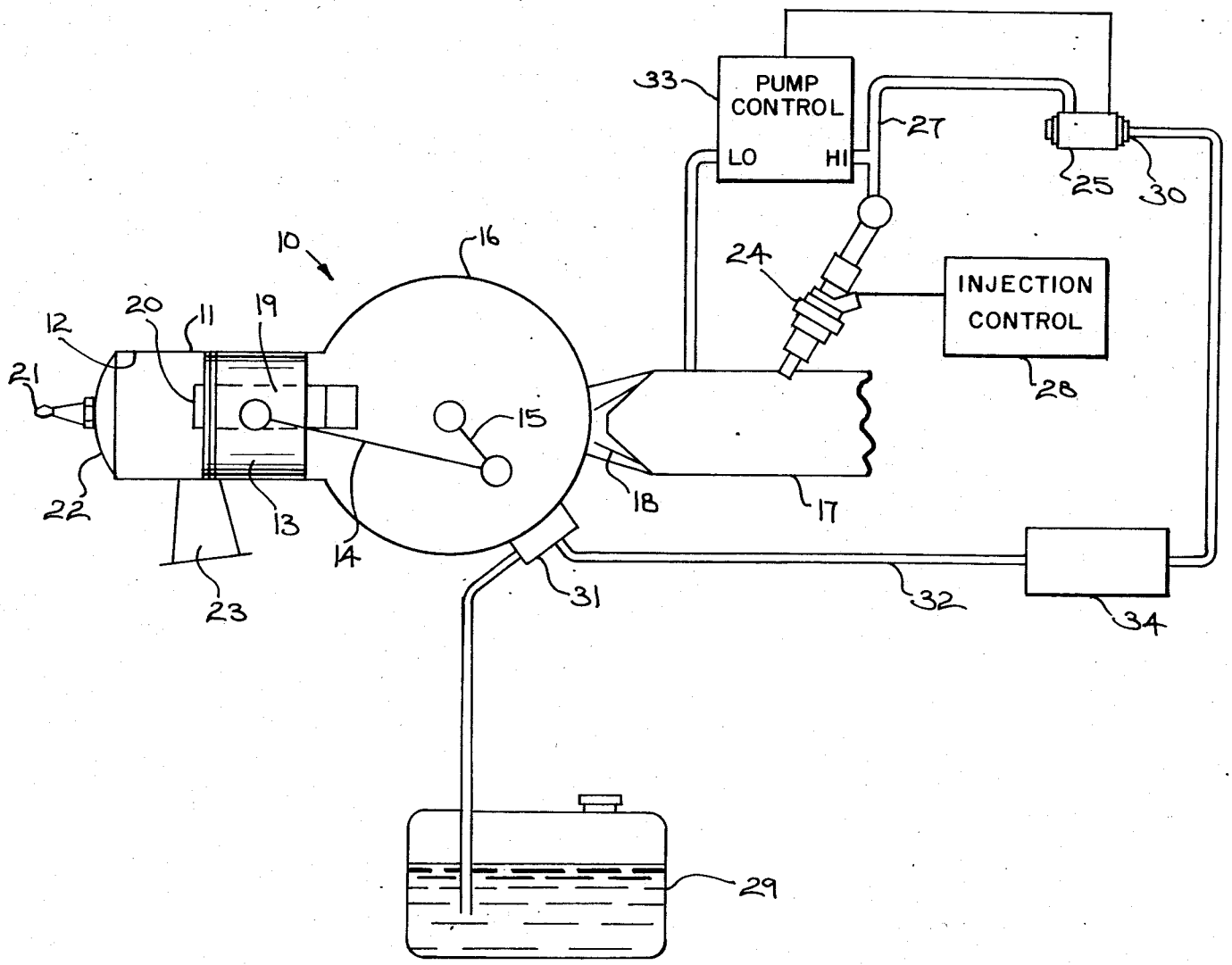
INJECTION CONTROL
PUMP CONTROL
HI
LO
10
11
12
13
14
15
16
17
18
19
20
21
22
23
24
25
27
28
29
30
31
32
33
34

CLOSED END FUEL INJECTION SYSTEM

BACKGROUND AND SUMMARY

The invention relates to marine fuel supply systems for fuel injected internal combustion engines, particularly where boating regulations prohibit fuel return from the engine to the remote fuel tank.

In fuel injected engines it is important to accurately control the quantity of fuel delivered to the engine through the fuel injectors. Many systems have been designed to control the operation of a fuel injector to accurately meter the fuel to the engine. It is common to use a high pressure pump to supply fuel to the injectors, with a pressure regulator providing an essentially constant fuel pressure at the injector. When the engine is located a significant distance from the fuel tank, it is common to provide a high capacity pump and recirculate excess fuel, i.e. the amount of fuel over and above that required by the engine, back to the fuel tank. In marine applications, however, it is undesirable to provide an extended fuel return line to the fuel tank, since fire or other hazards could arise.

Some prior systems have used recirculating type fuel injection pumps, with the excess fuel returning immediately to the inlet of the pump. In such systems, however, if the engine is operated at idle or low speeds for significant periods of time, the recirculating fuel accumulates heat from the pump and may vaporize. This typically would reduce the output of the pump to such a degree that adequate fuel pressure could no longer be maintained at the fuel injector.

Copending application Ser. No. 06/808,135, filed Dec. 12, 1985 by Robert J. Hensel and assigned to the same assignee of the present invention, provides a fuel supply system for a fuel injected engine located remotely from the fuel tank, without requiring a pressurized return fuel line between the engine and the tank. Such system includes a vapor separator assuring a vapor free supply of fuel.

The present invention provides another fuel supply system eliminating the fuel return line and eliminating recirculation through the fuel pump. In the present invention, a high pressure fuel line from the fuel injector pump is dead-headed at the fuel injector, i.e. closed-end connected to the fuel injector without a return fuel line to the fuel pump and without a return fuel line to the remote fuel tank. In the preferred embodiment, a differential pressure transducer is connected to sense the differential pressure across the fuel injector and turn off the fuel pump when the differential pressure is above a given value, and to turn on the fuel pump when the differential pressure drops below a second lower value, to maintain a predetermined pressure across the injector and hence an adequate supply of fuel available thereto. The invention also avoids the problem of recirculating oil back in with gas.

BRIEF DESCRIPTION OF THE DRAWINGS

FIG. 1 illustrates a marine fuel system in accordance with the invention.

DETAILED DESCRIPTION

FIG. 1 shows one cylinder of a two cycle, crankcase compression, internal combustion engine 10. The engine includes a cylinder block 11 having a cylinder bore 12 in which a piston 13 is supported for reciprocation. The piston 13 is connected by means of a connecting rod 14 to a crankshaft 15 that is journalled for rotation in the crankcase 16 of the engine 10.

The engine 10 includes an induction system including an intake manifold 17 connected to supply combustion air to crankcase 16 of engine 10. A reed type check valve 18 is provided in the passage to minimize blow back flow out of crankcase 16 into induction manifold 17. A transfer passage 19 extends from crankcase 16 through cylinder block 11 and terminates at an inlet port 20 in the cylinder wall at a point above the bottom dead center position of piston 13. A spark plug 21 is provided in the cylinder head 22 for firing the charge, and an exhaust port 23 is formed in the cylinder bore 12 to discharge exhaust gases to the atmosphere.

Engine 10 is provided with a fuel injection system that includes an electromagnetically controlled injector nozzle 24 that discharges into the induction system, either into crankcase 16, or into induction manifold 17 as shown. Fuel, typically gasoline, is supplied to injector 24 by a high pressure fuel pump 25 through high pressure fuel line 27. An electronic controller 28 controls the operation of injector 24 in known manner to deliver the desired amount of fuel to induction manifold 17 at the desired times.

During running of the engine, air is delivered to induction manifold 17 and fuel is injected by injector 24 to provide a fuel air mixture which is admitted to crankcase 16 through reed valve 18 while piston 13 is moving upwardly toward spark plug 21. Reed valve 18 opens during these conditions as long as the pressure in crankcase 16 is lower than that in induction manifold 1. As piston 13 moves downward toward crankcase 16, exhaust port 23 opens to discharge spend combustion products, and intake port 20 opens to allow transfer of air fuel mixture from crankcase 16 to cylinder 12. On the up stroke of piston 13, spark plug 21 is fired to ignite the mixture and the cycle continues in conventional manner.

In the present invention, and similarly with the above noted copending application Ser. No. 06/808,135, filed Dec. 12, 1985, fuel is drawn from a remote fuel tank to the inlet 30 of high pressure fuel pump 25. In preferred form, a low pressure pump 31 such as a diaphragm pump operated by the pulsating pressure in the engine's crankcase 16 is used to draw fuel from the remote fuel tank 29 and supply the fuel at low pressure through low pressure fuel line 32. Such diaphragm pumps are commonly used on outboard motors and produce a fuel output closely matched to engine requirements. A reservoir 34 is preferably provided in low pressure fuel line 32 from which fuel is drawn by high pressure pump 25 and which may also provide vapor separation. In an alternative embodiment, reservoir 34 is eliminated. In a further alternative embodiment, low pressure pump 31 is eliminated, and high pressure pump 25 draws fuel directly from tank 29 through fuel line 32.

In the present invention, high pressure fuel pump 25 is controlled by pump control 33 including a pressure sensor connected to sense the fuel pressure at the fuel injector and turn off pump 25 when the fuel pressure at the injector is above a first value and turn on the fuel pump when the fuel pressure at the injector is below a second value less than the first value. The preferred embodiment uses a Microswitch Control Corp P/N 142PC60A differential pressure transducer having a high pressure input connected to the high pressure fuel line 27 and a low pressure input connected to induction manifold 17 which varies in pressure from atmospheric to below atmospheric. The fuel flow rate through the orifice of the injector nozzle is determined by differential pressure across the orifice. By sensing the actual differential pressure across the injector, rather than comparison with atmospheric, there is enabled a more accurate control of the quantity of fuel delivered to the engine through the fuel injectors. A small range of pressure across the injector is preferred, such as 35.5 to 36.5 psi, with the fuel pump being turned off when the pressure in high pressure line 27 relative to induction manifold 17 is higher than such range, and with the fuel pump being turned back on when the relative differential pressure is below such range. High pressure fuel line 27 is thus deadheaded and dead-end connected to fuel injector 24 without a return fuel line to the fuel pump and without a return fuel line to remote fuel tank 29.

It is recognized that various equivalents, alternatives and modifications are possible within the scope of the appended claims.

What is claimed is:

1. A marine fuel system for an internal combustion engine having an induction system for supplying combustion air to the engine and fuel injection means for mixing fuel with the combustion air, and having a remote fuel tank, said fuel system comprising fuel pump means connected to draw fuel from said fuel tank and supply fuel under pressure to said fuel injection means, and pressure sensor means connected to sense the fuel pressure at said fuel injection means and connected to turn off said fuel pump means when said fuel pressure at said fuel injection means is above a first value and to turn on said fuel pump means when said fuel pressure at said fuel injection means is below a second value less than said first value, wherein said fuel is delivered by a high pressure fuel line from said fuel pump means to said fuel injection means, and wherein said high pressure fuel line is connected to said fuel injection means without a return fuel line to said fuel pump means and without a return fuel line to said remote fuel tank, the pressure in said high pressure fuel line being maintained between said first and second values, wherein said pressure sensor means comprises differential pressure transducer means connected to sense differential pressure between said high pressure fuel line and said induction system, to sense differential pressure across said fuel injection means.

2. The invention according to claim 1 wherein said engine comprises a crankcase and an induction manifold, and wherein said fuel injection means injects fuel into said induction manifold, and wherein said differential pressure transducer means has a high pressure input connected to said high pressure fuel line and a low pressure input connected to said induction manifold.

3. A marine fuel system for an internal combustion engine with a remote fuel tank, comprising:

an induction system for supplying combustion air to said engine;

fuel injection means for mixing fuel with said combustion air;

fuel pump means connected to draw fuel from said remote fuel tank and supply fuel under pressure to said fuel injection means;

pressure sensor means connected to sense the fuel pressure at said fuel injection means and connected to turn off said fuel pump means when said fuel pressure at said fuel injection means is above a first value, and to turn on said fuel pump means when said fuel pressure at said fuel injection means is below a second value less than said first value;

a high pressure fuel line connected from said fuel pump means to said fuel injection means, and wherein:

said pressure sensor means comprises differential pressure transducer means connected between said high pressure fuel line and said induction system to sense differential pressure across said fuel injection means; and said high pressure fuel line is connected to said fuel injection means without a return fuel line to said fuel pump means and without a return fuel line to said remote fuel tank.

4. The invention according to claim 3 wherein:

said induction system includes an induction manifold varying in pressure from atmospheric to below atmospheric;

said fuel injection means injects fuel into said induction manifold; and said differential pressure transducer means has a high pressure input connected to said high pressure fuel line and a low pressure input connected to said induction manifold.

5. The invention according to claim 3 wherein said fuel pump means comprises first and second fuel pumps, said first fuel pump connected to draw fuel from said tank and supply said fuel at low pressure through a low pressure fuel line, said second fuel pump connected to receive said low pressure fuel through said low pressure fuel line from said first fuel pump and providing high pressure fuel through said high pressure fuel line to said fuel injection means, and wherein said second fuel pump is turned on and off by said differential pressure transducer means.

6. The invention according to claim 5 comprising reservoir means in said low pressure fuel line between said first and second fuel pumps.

* * * * *